United States Patent [19]

List

[11] 4,094,439

[45] June 13, 1978

[54] ARTICLE APPORTIONING APPARATUS HAVING A ROTATABLE DRUM

[76] Inventor: Hans List, Laustrasse 51, 7 Stuttgart 70 BRD, Germany

[21] Appl. No.: 684,631

[22] Filed: May 10, 1976

[30] Foreign Application Priority Data

| | | |
|---|---|---|
| May 9, 1975 | Germany | 2520685 |
| Nov. 13, 1975 | Germany | 2550987 |

[51] Int. Cl.[2] ..... B23Q 7/12

[52] U.S. Cl. ..... 221/9; 53/54; 53/59 R; 221/169; 221/265

[58] Field of Search ..... 221/7, 13, 21, 159–161, 221/167–169, 197, 233, 251, 265, 277, 281, 312, 9; 53/54, 59 R; 222/349, 352; 15/305

[56] References Cited

U.S. PATENT DOCUMENTS

| | | | |
|---|---|---|---|
| 2,082,051 | 6/1937 | Falconer | 15/305 |
| 2,343,496 | 3/1944 | Carroll | 221/233 X |
| 2,597,290 | 5/1952 | Childers | 221/281 X |
| 2,812,137 | 11/1957 | Curtis et al. | 53/59 R |
| 2,990,975 | 7/1961 | Sereno | 222/349 X |
| 3,318,434 | 5/1967 | Waller | 221/169 X |
| 3,407,964 | 10/1968 | Wysocki et al. | 221/167 X |
| 3,722,740 | 3/1973 | List | 221/7 |

*Primary Examiner*—Stanley H. Tollberg
*Assistant Examiner*—Fred A. Silverberg
*Attorney, Agent, or Firm*—Michael J. Striker

[57] ABSTRACT

An apparatus for handling a multiplicity of like bodies such as pills or tablets has a drum rotatable in a housing about a horizontal axis and formed with a multiplicity of throughgoing holes constituting body-receiving pockets. A pair of axially spaced end walls axially close the drum and a pair of inner and outer shields insure that except for an inner input location and an outer retrieval location bodies in the apertures of the drum will not fall out as the drum rotates. A pair of transparent end walls are rigidly mounted together by way of axially extending bolts and carry feed plates, a separating comb, and a separating disc. These end plates and the elements carried on them are slidable axially into and out of the drum. The separating comb is formed of a plurality of axially spaced and parallel elements that define slits that are aligned with the rows of apertures in the drum and between which fit elastomeric discs carried on the separating roller. One end of the comb can be hooked over an axially extending tierod or bolt and the other end can be releasably secured to the end plates also so that this comb can readily be removed from the apparatus and replaced with another comb of different dimensions.

17 Claims, 12 Drawing Figures

ARTICLE APPORTIONING APPARATUS HAVING A ROTATABLE DRUM

BACKGROUND OF THE INVENTION

The invention relates to an apparatus for counting and dosewise apportioning of tablets, dragees, gelatine capsules, and like bodies with a drum rotatable about a horizontal axis and having through-going apertures arranged in rows parallel to the rotation axis and forming receptacles for the bodies; cylindrical walls partly covering the drum on its inner and outer periphery to prevent the unintentional falling-out of the bodies; with a feed mechanism for the bodies extending into the interior of the drum, as well as with a forming grid arranged above the lower portion of the drum inside the drum and having inclined guide surfaces for the alignment and feed of the bodies into the receptacles, this grid being comprised of circular ring segments secured together and spaced apart by a holder, the grid forming together with semicircular parallel side walls arranged at the ends of the drum and held apart by distance bolts as well as with the inclined guide surfaces an ordering arrangement slidable axially out of the apportioning apparatus.

In such an apportioning apparatus the ordering grid is pivotally mounted at its upper end and is provided on its lower end with a cam arrangement which vibrates. This vibration increases the effectiveness of the ordering grid which serves to order the randomly loaded-in bodies in the apportioning apparatus, for example medication in tablet or dragee form, to place these bodies parallel to each other and to guide them into the receptacles of the counting drum.

SUMMARY OF THE INVENTION

It is an object of the invention to simplify the construction of the known apportioning apparatus and in particular to facilitate its use with other sizes and shapes of bodies to be counted and apportioned.

This object is attained according to this invention in that the ordering grid is releasably connected with the side wall of the ordering apparatus. This makes it possible to change the apportioning apparatus only by switching the ordering grid quickly and easily to other tablet or dragee sizes or to fit it out for apportioning of such tablets, dragees, or bodies whose sorting and handling normally presents considerable difficulties due to their shape.

In accordance with another feature of this invention the ordering grids or the ordering grid for the counting and apportioning of the bodies of the last-named type is so dimensioned that the grid extends over at most a third of the circumference of the drum. In accordance with this feature there is, seen in the rotation direction of the drum, between the downstream edge of the semicylindrical wall provided inside and covering the upper region of the drum and the upper edge of the ordering grid a sufficient space and therefore a free area in which excess bodies leave the drum or can be removed from the drum without the danger of damaging these bodies.

As experience has shown substantial difficulties are encountered in apportioning dragees, in particular when they are very flat, as well as in the apportioning of elongated gelatine capsules. This is caused by the dragee partially entering a receptacle and becoming wedged therein on top of a dragee already ordered in the receptacle. If such a dragee moves to the downstream edge of the cylinder-shaped inner wall inside the drum there is the danger that the dragee will be sheared off and damaged by this element. Such a danger of damaging a wedged-in body in the manner described or a similar way is minimized when the ordering frame is so dimensioned and arranged that its end lying downstream in the drum forms centered on the drum axis and with respect to the horizontal plane, an angle of 40°-50° and when in addition in the lower region of the interior of the drum a stripping arrangement is provided whose stripping elements engage into the region of the receptacles in the vicinity of the inner upper surface of the drum. In order to avoid a barrier hindering falling-out of excess pills in the region of the end of the ordering grid adjacent the upstream end of the cylinder-like wall, the circular ring segments forming the ordering grid are provided with radially extending lugs in this region which are equispaced apart by spacing elements.

Excess bodies are very carefully stripped away by an apparatus which in accordance with further features of this invention lies behind the ordering grid in the rotation direction of the drum and the stripping elements are arranged in continuations of the guide slits. In this arrangement the stripping device, if necessary, can have several stripping elements arranged one behind the other for each guide slit.

In order to order elongated gelatine capsules it has been shown advantageous to arrange the stripping device in the region of the ordering grid and to set it up such that the stripping elements project into the guide slits.

In order to ensure a fast exchange of one ordering grid with another, the grid elements are provided on their lower ends on both sides with hooks which have recesses for receiving a connecting rod in the preferably transparent side walls of the ordering apparatus. In addition, the ordering grids have on both of their outermost circular ring elements respective bores for the pin of a fixing screw extending through the side wall of the ordering apparatus. After release of the two fixing screws the respective ordering grid hangs on the connecting rod and can be quickly exchanged with another ordering grid with another slit width, another slit number, and/or other dimensions.

In accordance with a further feature of the invention an ordering roller having cam-like discs is provided in the ordering apparatus, these discs engaging in the guide slits. The ordering roller is journalled in the side walls and is also a part of the ordering apparatus.

By means of the ordering roller and the through-going slits of the ordering grid, the bodies to be apportioned are ordered and fed into the receptacles of the counting drum in a simpler and gentler manner than this can be done with a vibrating mechanism as is provided or necessary on the known apportioning apparatuses. Such vibrating mechanism must in addition engage on corresponding abutments on the drum and must for this reason be set up for the particular drum. In addition, such a vibratory mechanism uses a substantial amount of energy which is spared according to the present invention.

In addition to the mentioned advantages the apportioning apparatus according to the invention as a result of its simple construction is relatively inexpensive to build and run and thereby works more efficiently.

BRIEF DESCRIPTION OF THE DRAWING

In the drawing there is shown an embodiment of the apparatus of the invention. There is shown in.

SPECIFIC DESCRIPTION OF PREFERRED EMBODIMENTS

Figure 1:
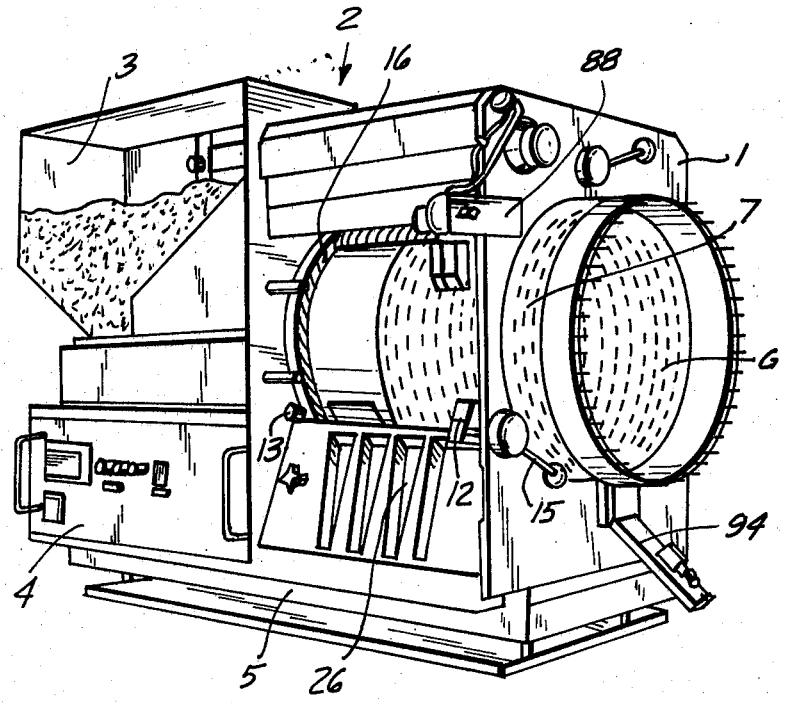
FIG. 1 a counting and apportioning machine provided with the apparatus according to the invention in perspective view, FIG. 2 an apparatus according to the invention in axial section, FIG. 3 the apparatus according to FIG. 2 in a view in axial section corresponding to line III—III of FIG. 2, FIG. 4 the apparatus according to FIG. 3, however, with an elongated ordering grid and without a stripping device, FIG. 5 an ordering roller of the invention according to FIG. 2 in a partly sectional view corresponding to line V—V of FIG. 3 or of FIG. 4, FIG. 6 the ordering roller according to FIG. 5 as well as a part of an ordering grid and a drum of the apparatus according to FIG. 4 in a sectional view corresponding to line IV—IV of FIG. 5, FIG. 7 the ordering grid according to FIG. 4 in a partial view in a section parallel to the drum axis, FIG. 8 the ordering grid, a stripping device, and a portion of the wall of the drum of the apparatus according to FIG. 2 in a view in the direction of the drum axis, FIG. 9 the stripping device of FIG. 8 in a partial section, FIG. 10 another embodiment of a stripping device of the apparatus according to FIG. 2 in a partial view corresponding to the view of FIG. 9, FIG. 11 the ordering grip according to FIG. 4 in a view at a right angle to the drum axis, FIG. 12 a partial view of the ordering grid along the section line XII—XII of FIG. 11.

An apparatus 1 according to the invention for counting and dosewise apportioning of tablets, dragees, gelatine capsules, and such bodies —hereinafter referred to as an apportioning apparatus— forms the center of a counting and apportioning machine 2 (FIG. 1). It is secured together with a filling hopper 3 and with a housing 4 containing the drive and control mechanisms on a common frame 5.

Figure 2:
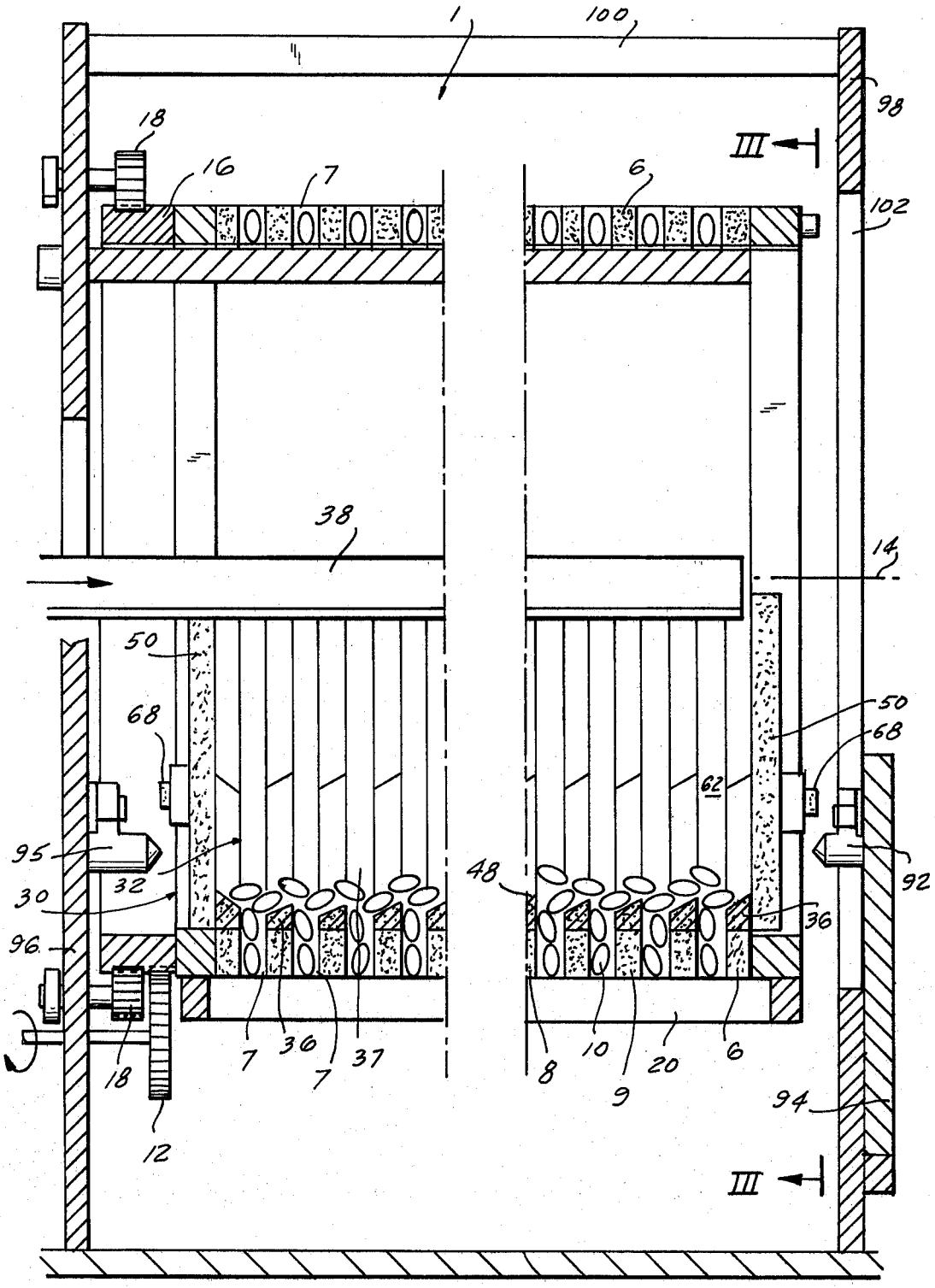
Figure 3:
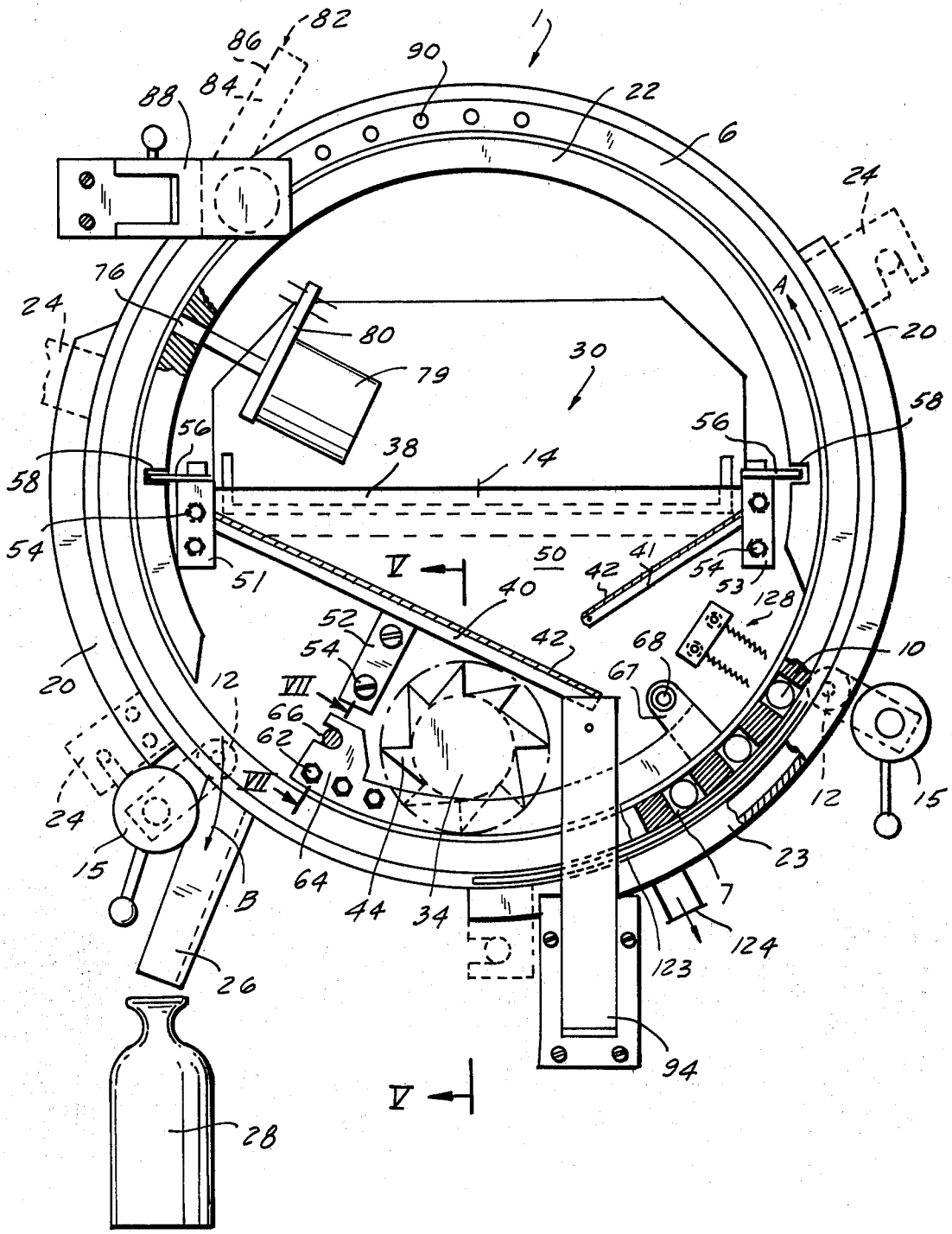
Figure 4:
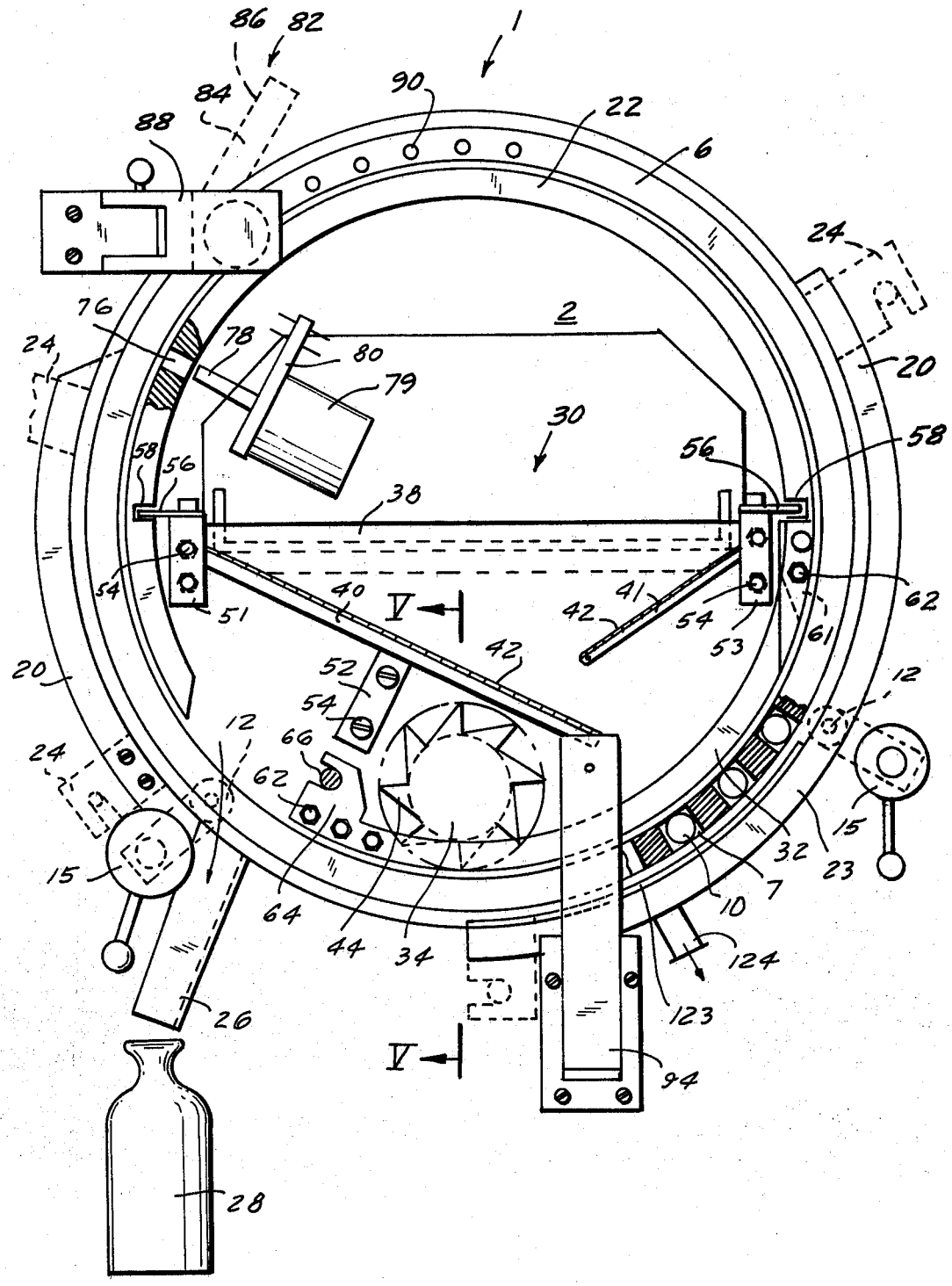

The apportioning apparatus 1 is provided with a rotatable drum which has a great number of throughgoing receptacle-forming apertures 7 which are arranged in columns parallel to the rotation axis of the drum and in rows in the circumferential direction of the drum (compare here also FIGS. 2 and 3, 4). The apertures 7 are separated from each other axially by webs 8 and circumferentially by webs 9. They serve as receptacles for the bodies 10 to be apportioned, which in the following by way of example are referred to as dragees.

The drum 6 is supported at its both ends on rollers 12 and 13. The outer rollers 12, which are covered in FIG. 1 by their housing, can be swung out by means of a lever mechanism 15 whereupon the drum 6 can be pulled out of the machine. In FIG. 1 the drum 6 is shown pulled partly out of the apparatus 1. A one-ended supporting of the drum 6 in the region of end lying to the left in the drawing is also possible.

Figure 8:
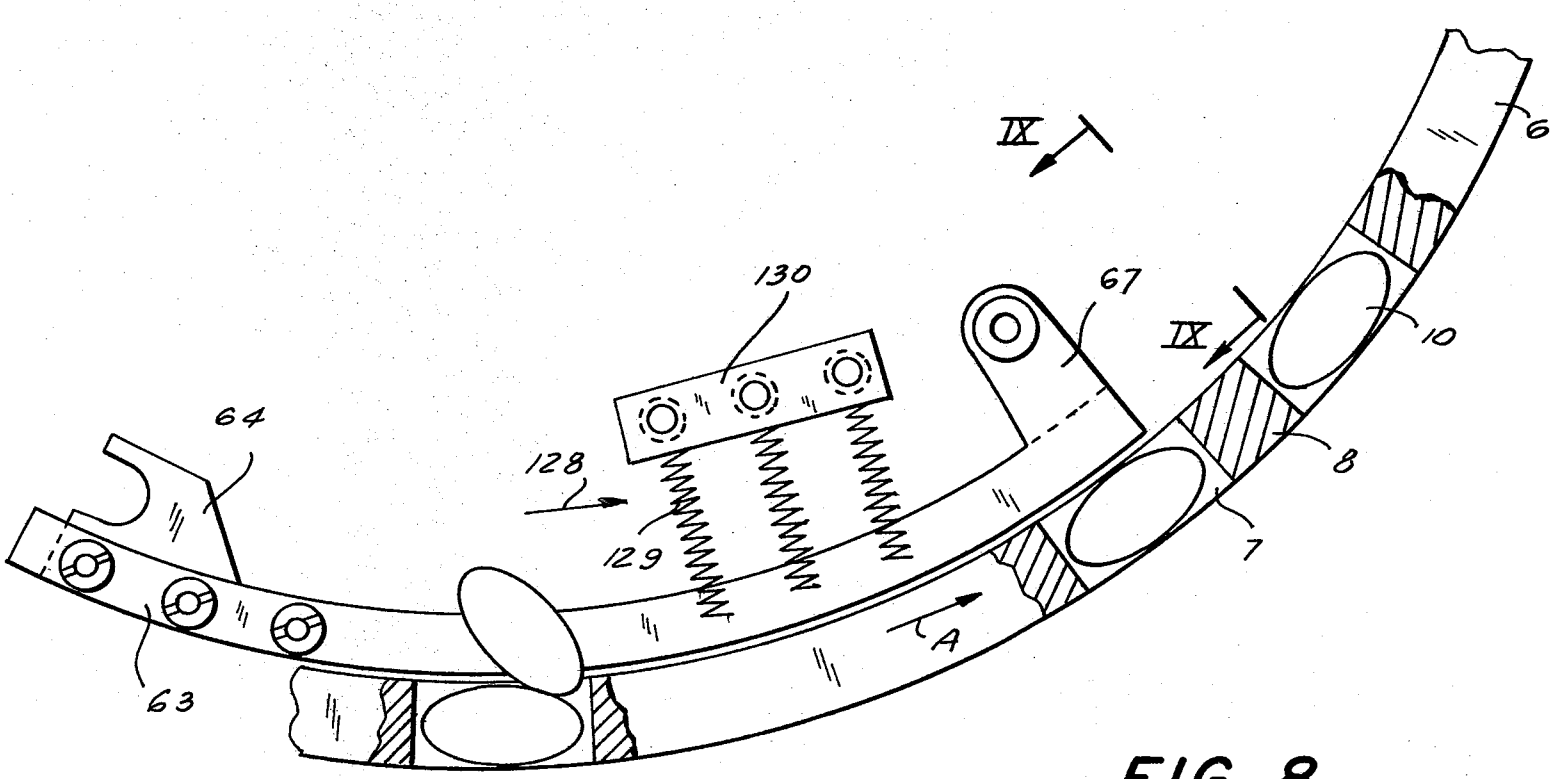

The drum 6 is releasably connected on its end lying to the left in the drawing with the drive ring 16 (compare FIGS. 1 and 2) which is driven by means of gears 18 in order to rotate the drum 6 about its arms 14. Its rotation direction is shown in FIGS. 3, 4 and FIG. 8 by an arrow A. The wall of the drum 6 having the apertures or receptacles 7 is outwardly partially covered by a part-cylindrical outer wall 20 and inwardly partly covered by a part-cylindrical inner wall 22 in order to prevent a premature falling-out of the tablets from the receptacles 7 of the drum 6. The outer wall 20 which covers the lower half of the drum 6 is subdivided and removably constructed. Its holders are shown at 24 (FIGS. 3, 4). In FIG. 1 the front part of the wall or shield 20, which lies to the left in FIGS. 3, 4, is removed. Below the downstream end of the left half of the subdivided outer wall 20 there are provided several apportioning wells 26 by means of which the dragees 10 can enter containers 28, for example glass bottles, standing underneath. With a rotating drum 6 the dragees 10 contained in the receptacles 7 fall by rows from the drum 6 as soon as an axial row of receptacles 7 passes the end of the left shield 20 and moves to a position above the apportioning wells 26. In FIGS. 3, 4 the falling dragees are shown by an arrow B. The inner wall 22 covers the drum 6 substantially in its upper region and prevents the dragees 10 entering in the lower regions of the drum into the receptacles 7 from falling back out into the interior of the drum 6.

Inside the drum 6, in its lower half, is a so-called ordering device 30 which substantially consists of an ordering grid 32 and an ordering roller 34. The ordering grid 32 covers the drum 6 in its lower region and extends substantially from the apportioning well 26 to the middle of the drum quadrant lying to the lower right in FIG. 3. It covers therefore a portion of substantially 60° to 120° of the inside periphery of the drum. The ordering grid 32 is made up of individual annular ring segments 36 which are separated from each other by guide slits 37 (compare FIGS. 2, 3, 4, and 8). The guide slits 37 are each arranged over a respective row of circumferentially spaced receptacles 7 of the drum 6. They serve to order the dragees 10 which are fed randomly into the apportioning device 1 to that these dragees 10 one after another come into a position in which they can enter into the receptacles 7. With disc-like tablets the preferred position on FIGS. 3 and 4 is seen, that is the tablets stand radially in the receptacles. Elongated capsules on the contrary must lie flat, that is extend circumferentially in the receptacles 7 as shown in FIG. 8. The tablets or capsules 10 are therefore first ordered into parallel rows next to each other before they enter the receptacles 7. This marshalling, that is the ordering, aligning, and feeding of the capsules 10 into the receptacles 7, is the job of the ordering grid 32 and is aided by the ordering roller 34 as described below.

The dragees to be apportioned, come from the filling hopper 3 by means of a chute 38 (FIGS. 2, 3, and 4) into the apportioning apparatus. The chute 38 is so constructed that the dragees are evenly spread over the length of the drum 6. The dragees falling from the chute 38 land on two downwardly inclined and axially extending slide and guide plates 40, 41 which are provided on their upwardly turned sliding surfaces with a resilient material 42 in order to prevent damaging of the dragees. The guide plates 40, 41 are so arranged that the dragees 10 fall into the region next to the ordering roller 34 on the ordering grid 32.

Figure 5:
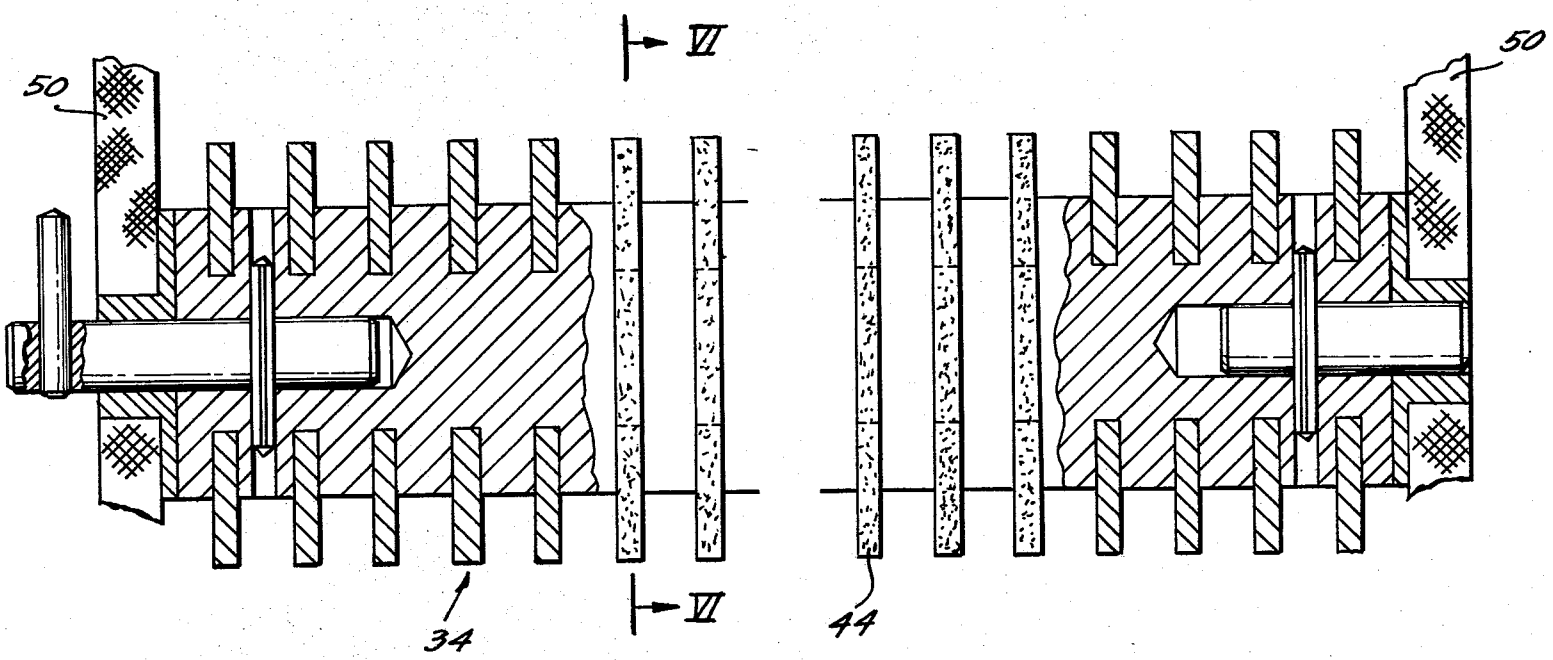
Figure 6:
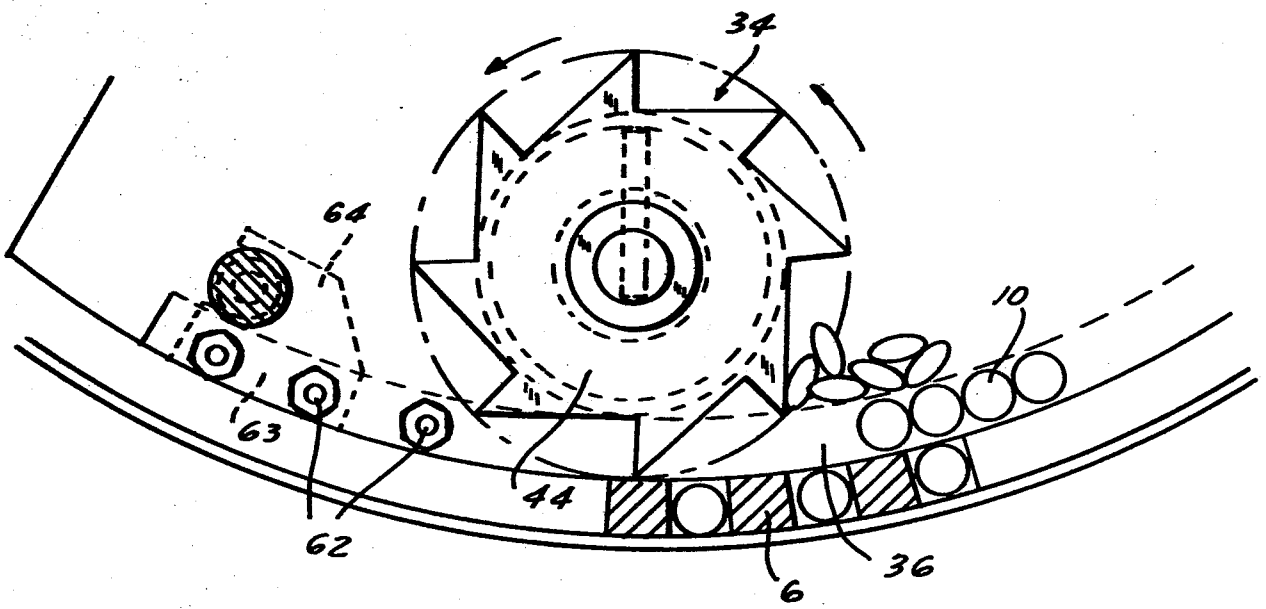

The ordering roller 34 has discs 44 provided with tooth-like cams (compare also FIGS. 5 and 6) of elastic material, for instance of rubber, which engage in the guide slits 37 of the ordering grid 32. The ordering roller 34 is set into rotation by a drive, not shown in the drawing, which is outside the drum 6 and therefore sets the dragees 10 into motion which lie randomly on the circular ring segments 36 of the ordering grid. This motion ensures that the dragees constantly fall into the guide slits 37 and therefore are fed to the drum in sufficient quantities in order to fill up all of the receptacle 7. The cams or teeth of the discs 44 have a flank shape which is so chosen that on rotation they pull the dragees inwardly in order constantly to keep them in motion but without entraining them sufficiently to carry them over to the other side of the ordering roller 34. The circular ring segments 36 each have on their inner peripheries an inclined guide surface 48 which facilitates the feeding-in of the dragees 10 into the slits 37.

On both of its axial ends the ordering device 30 has a semicircular side wall 50 (FIG. 2) which is made of a transparent material, for instance from plexiglass. The two side walls 50 are held parallel to each other by three spacer elements 51, 52, and 53 extending axially in the drum and are held rigid to each other by anchors 54 extending through each of the three pairs of spacers 51, 52, and 53 extending through the side walls 50. On the two outer, in use upwardly lying, spacers 51 and 53 axially extending guide rails 56 are screwed which engage each in a respective groove 58 on the inner wall 22. The guide plates 56 and the grooves 58 serve as guides for the ordering apparatus 30 which can therefore be slid into the apportioning apparatus 1 and pulled again therefrom. At particular locations there are provided abutments not shown in the drawing by which the position of the ordering apparatus 30 and therefore the position of the grid 32 relative to the drum 36 can be fixed precisely.

The slide plates 40 and 41 are releasably secured to the spacers 51, 52, and 53, for example by means of screws, so that they can be taken out for cleaning or exchange easily from the ordering apparatus.

Figure 7:
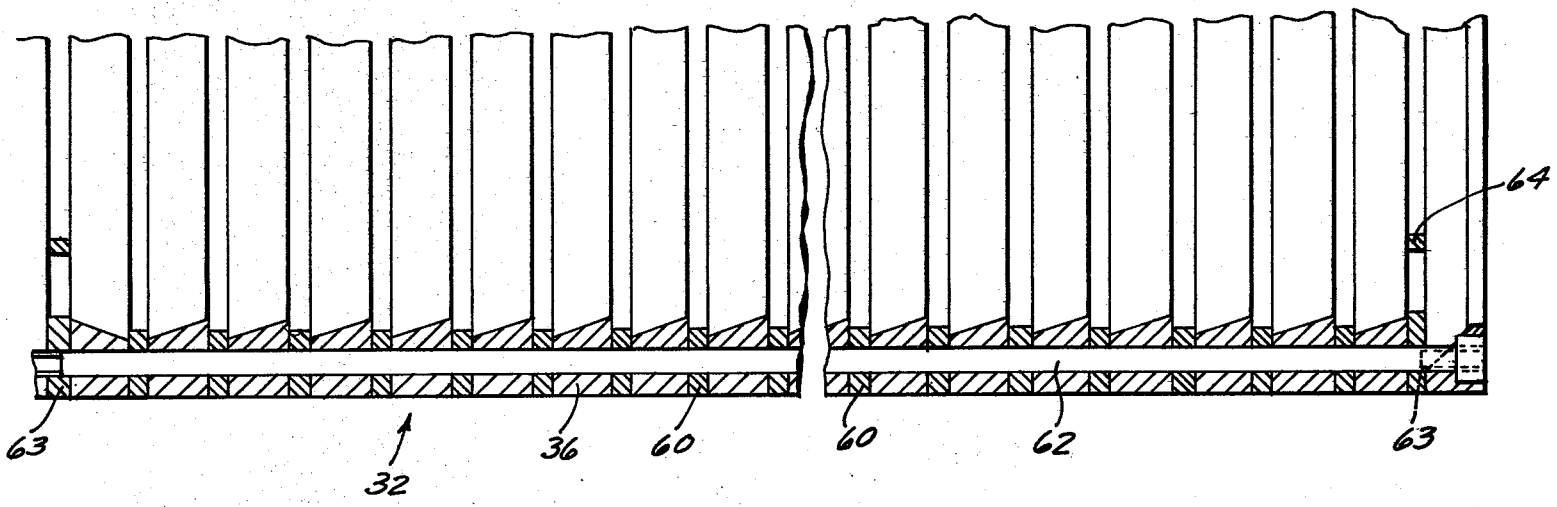

The individual circular ring segments 36 of the ordering grid 32 are only held apart on their front and rear ends by intermediate spacers 60 and 61, respectively, and are connected to each other by through-going anchors 62. A section through the front end lying to the left in the drawing of the ordering grid 32 is shown in FIG. 7. At this end the circular ring segments 36 are connected together by three adjacent anchors 62. In order to secure the ordering grid 32 in the ordering apparatus 30 the two outermost spacers 63 have on their front ends holding claws 64 (FIGS. 3, 4, 7 and 8). The two end walls 50 of the ordering apparatus 30 are also connected to each other by spacers which are formed as round rods 66 (FIGS. 3 and 4) on which the ordering grid 32 can be secured simply by hanging of the holding claws 64. On the rear end shown to the left in the drawing of the grid there are circular ring segments 36 with radially extending tabs 67 which are held apart by spacers 61 (compare FIGS. 3, 9, and 10) and connected together by means of another anchor tab 62. The screws 68 extending through the two side walls 50 are threaded into the two outermost lugs 67. After the grid 32 has been hung at its front end on the round rod 66 its rear end is fixed by the screws 68, one on each side, in the ordering device 30.

When the apportioning apparatus 1 is to be changed over for other capsules or dragee types or for another size, the ordering grid 32 after loosening of the two screws 68 is unhooked from the rod 66 and can therefore be exchanged readily with an ordering grid having another slit width, with different high circular ring elements or if desired, with a different number of slits. The ordering grid 32 forms on one side therefore the smallest possible part which must be changed in order to change over the apportioning device 1 so that the original equipment and maintenance costs are reduced considerably. Should the capsule size for changing-over of the apparatus exceed a certain limit it is also necessary to exchange the drum 6 for another drum with different receptacles 7.

The inner wall 22 is provided above the ordering device 30 and in the region of the circle quadrant shown to the upper left in FIGS. 3 and 4 with a through-going knock-out slit 76 extending parallel to the drum axis. This slit 76 is associated with a correspondingly shaped knock-out bar which is operated by a push magnet 79. The magnet 79 is secured on a plate 80. It receives its control pulses from a full-count control device shown at 82. This control device has a row of parallelly arranged sensing blades 84 which are urged against the outside of the drum each in the region of a circumferential row of receptacle 7. The feeler blades 84 engage during rotation of the drum 6 the dragees 10 in the receptacle 7. If only one dragee of the axially extending row moving past is missing the respective feeler blade 84 will move into the corresponding receptacle 7 and thereby swing about its pivot axis and break a light beam with its other end. Such interruption of the light beam creates a control pulse which actuates the belt pusher 88. The bolt pusher 88 pushes thereby a counterbolt 90 arranged slidably on the end of the drum in line with the respective row of receptacles. The counter bolts are engaged by a not-illustrated wheel which for each fully filled receptacle row is rotated by one step. Since the counter bolt 90 in the case of an insufficiently filled receptacle row is brought into its ineffective position and cannot be engaged by the wheel in this position it is insured that only dragees are counted which are in fully filled axially extending rows of receptacles 7. The dragees in rows which have been established by the full-count control device 82 to lie in partially unfilled rows are knocked out of the corresponding row of receptacles by the solenoid 79. This solenoid 79, actuated by a corresponding control pulse, strikes the knock-out bar 78 against the inner surface of the drum and thereby throws all of the dragees 10 out of the partially filled row. These dragees 10 are therefore neither counted nor filled into the bottles 28. The bolt pusher 88 is pivotally mounted so that it can be swung down when the drum 6 is taken out of the apportioning device 1. FIG. 1 shows it in swung-out condition.

A part 92, for example the receiving part of a light barrier, is also mounted on the pivoted holder 94 (FIGS. 2, 3, and 4). The sending part 95 of the light barrier is secured on a housing at the end wall 96 of the apportioning apparatus 1. The light barrier 92, 95 serves to ascertain the filling level of dragee 10 inside the drum 6 and correspondingly to control the feed of dragees to the chute 38.

FIG. 2 shows to the right how the outer side wall 98 of the housing of the apportioning apparatus 1 is connected via intermediate pieces 100 with the back wall 96. The front wall 98 has a circular aperture 102 whose diameter is greater than the outer diameter of the drum 6.

The right portion of the outer wall 20 is formed in at least its lower region as a vacuum chamber 23 which opens via a row of sucking slits 123 toward the outer surface of the drum 6 as shown in FIGS. 3 and 4. The sucking slits 123 are so arranged that they are not aligned with the receptacles 7, but with the webs 9 of the drum 6 separating these receptacles. This vacuum chamber 23 is provided with suction connections connected to a vacuum source, for example a pump. This insures that dust collecting in the receptacle 7 of the drum is effectively vacuumed out so as not to hinder the counting and sorting of the capsules 10.

The ordering grid 32 is arranged adjacent a stripping mechanism 128 (FIGS. 3, 8, 9, and 10) which is comprised mainly of elastic stripping element 129 and a holder 130 for these elements. The holder 130 is releasably secured at its two ends on the transparent sides walls and therefore forms a part of the ordering apparatus 30. Helical springs are used as stripping elements 29, it is also possible to use other resilient elements. They must have sufficient stiffness to perform their function.

Stripping elements 129 are so arranged that they extend right up to the inner surface of the drum 6, indeed into the region of the receptacles 7. Each holder 130 can be provided with two or three parallel circumferentially spaced rows of stripping elements. When the drum rotates the receptacles move circumferentially under two or more spaced-apart stripping elements 129. In particular cases it is possible to use a single row of stripping elements 129. The stripping device 128 can as shown in FIG. 3 be arranged in the rotation direction behind the ordering grid 32. The stripping elements 129 therefore lie in the continuation of the slits 37. The stripping device 128 can also as shown in FIG. 8 lie directly above the ordering grid 32. In this case the stripping elements engage in the slits 37.

The stripping apparatus also serves to position elongated, preferably cylindrical, capsules 10 gently inside the guide slits 37 of the grid 32 so that they lie down in the receptacles 10 and only in this position are entrained away by the drums 6. Mainly the stripping device 128 prevents excess capsules or dragees wedged or otherwise stuck in the receptacles from being entrained away by the drum and thereby destroyed. Not only badly positioned dragees but also excess dragees or capsules 10 are gently separated from the drum by the stripping device and thereby fall again onto the ordering grid where they can be uniformly ordered in the receptacles.

Figure 10:
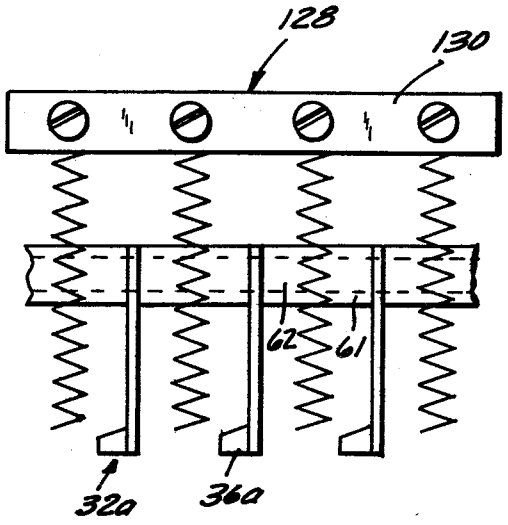
Figure 9:
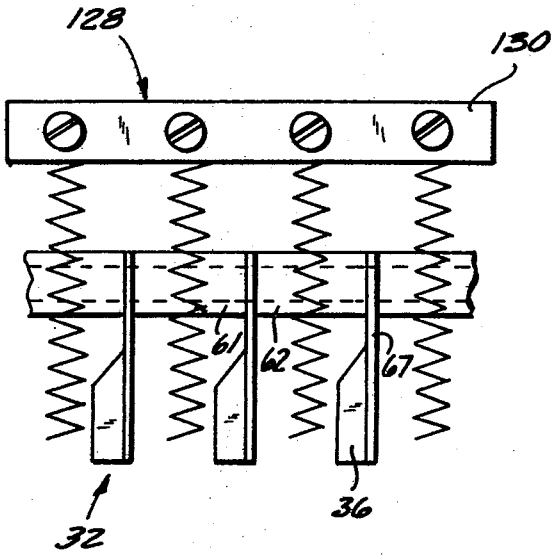

FIGS. 9 and 10 also show an embodiment of a grid 32 and a therewith associated stripping arrangement 128 in a section in the circumferential direction. The grid 32 of FIG. 9 is used for the ordering of many disc-like tablets and dragees. The grid **32*a* of FIG. 10, whose circular ring segments 36*a* have a shorter height than the ring segments 36 of FIG. 9** is used mainly for ordering of elongated cylindrical capsules.

Figures 11, 12:
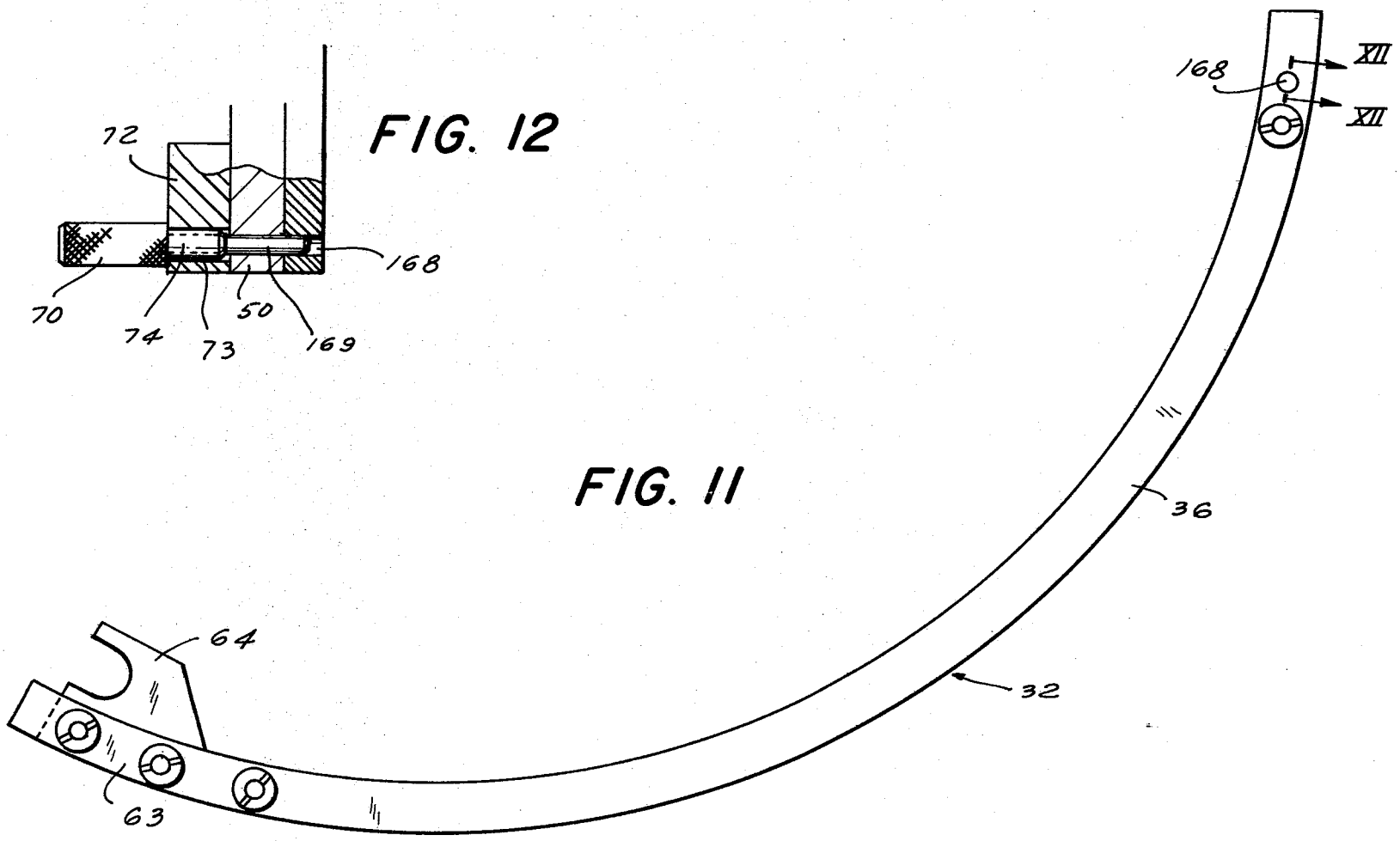

With the grid according to FIGS. 11 and 12 the two outermost circular ring segments 36 are each provided with a bore 168 in which the index pin 169 of an indexing screw 70 (FIG. 12) may be inserted. The indexing pin 169 is also insertable in a bore of a corresponding side wall 50 and in the region of this bore the side wall 50 is provided with a reinforcement plate 72 (FIGS. 2 and 12) which has a threaded bore 93 in which the index screw 70 with a corresponding threaded portion 74 is threaded. With two such indexing screws 70, one on each side of the ordering arrangement 30, the ordering grid 32 after it is hung at its lower end on the round rod is fixed at its upper end in the ordering apparatus 30. When therefore the apportioning apparatus 1 must be switched over to another tablet or dragee size the ordering grid 32 is unhooked after loosening of the two indexing screws 70 from the round rod 66 and therefore can in very short time be exchanged with an ordering grid having different slit widths and/or different slit number and/or other dimensions.

I claim:

1. An apparatus for handling a multiplicity of like bodies, said apparatus comprising:

a housing;

a drum rotatable in said housing about a horizontal axis and having a multiplicity of inwardly open pockets arranged in circumferentially extending axially spaced rows and each dimensioned to hold one of said bodies;

a pair of axially spaced end walls in and axially closing said drum and defining therewith a separating space;

connectors extending axially between and axially securing together said end walls;

means for rotating said drum about said axis in a predetermined rotational sense relative to said end walls and to said housing;

input means for feeding a multiplicity of said bodies in random fashion into said space at a given input location therein;

end bolts extending axially between said end walls;

guide plates inclined downwardly at said input location and receiving said bodies from said input means;

a separating comb having a plurality of arcuate elongated separating elements defining a plurality of parallel slits and at least one rod extending transversely to and rigidly secured to said separating elements, said rod being held on and extending axially between said end walls;

means for joint sliding of said end walls, connectors, and comb axially out of said drum and out of said housing;

means including a pair of axially spaced hooks on said comb engageable over said rod for releasably securing said comb to said end walls in a position generally below said axis in said space downstream relative to said rotational sense from said location and with said slits each aligned with a respective one of said rows;

means for removing said bodies from said pockets at a removal location located downstream of said comb relative to said rotational sense; and shields closely juxtaposed with said drum and fixed to said housing in such positions that said bodies cannot fall out of said pockets between said input location and said retrieval location, said shields having formations constituting said means for joint sliding.

2. The apparatus defined in claim 1, wherein said means for securing includes a screw threadable into said end wall and having an end axially engageable with said comb.

3. The apparatus defined in claim 1, further comprising a roller rotatable about an axis parallel to said axis of said drum and having a plurality of toothed discs each extending into a respective one of said slits and having an outer periphery spaced radially inwardly of said drum, said roller having ends journalled in said end wall.

4. The apparatus defined in claim 1, wherein said separating elements of said comb extend angularly relative to said axis through at most 60°.

5. The apparatus defined in claim 4, wherein one of said shields is an inner shield lying within said drum and having an upstream axially extending edge, said comb having a downstream end spaced between 40° and 50° relative to said axis upstream of said upstream edge.

6. The apparatus defined in claim 1, wherein said comb has an upstream end provided with said rod and a downstream end provided with another such rod, said comb further having at said downstream end a radially inwardlly extending tab, said comb further comprising a plurality of spacers at said rods between said elements.

7. The apparatus defined in claim 1, further comprising a plurality of stripping members secured to said end walls and having ends closely juxtaposed with the inner surface of said drum downstream of said input location and upstream of said retrieval location.

8. The apparatus defined in claim 7, wherein said stripping members engage in said slits.

9. The apparatus defined in claim 7, wherein said stripping members are located downstream of said comb.

10. The apparatus defined in claim 7, wherein a plurality of said stripping members are aligned with each of said slits.

11. The apparatus defined in claim 7, further comprising a holder extending between said end walls and carrying said stripping members, and means releasably securing said holder to said end walls.

12. The apparatus defined in claim 7, wherein said stripping members are coil springs.

13. The apparatus defined in claim 1, wherein said shields include an inner shield closely juxtaposed with the interior of said drum above said axis and formed with an axially extending throughgoing slit, said drum having a multiplicity of throughgoing apertures constituting said pockets, said apparatus further comprising a knock-out bar aligned inside said drum with said throughgoing slit and means connected to said bar for displacing same through said throughgoing slit into engagement with the interior of said drum and with a row of bodies in a row of apertures aligned with said throughgoing slit.

14. The apparatus defined in claim 13, further comprising means for detecting the absence of a body in a one of said apertures adjacent said throughgoing slit and for operating said means connected to said bar for knocking the bodies out of a row having an empty aperture.

15. The apparatus defined in claim 1, wherein said shields include an outer shield surrounding and closely juxtaposed with said drum below said axis except at said retrieval location and partially formed with a plurality of circumferentially extending slots axially offset to and between said rows of pockets, said apparatus comprising means for aspirating air through said slots to clean said drum.

16. The apparatus defined in claim 1, wherein said guide plates extend axially and are oppositely inclined to the horizontal, said apparatus further comprising means for releasably securing said plates to said end walls.

17. The apparatus defined in claim 16, wherein each of said plates has a soft covering on its upper surface.

* * * * *